US010502429B2

(12) United States Patent
Billman et al.

(10) Patent No.: US 10,502,429 B2
(45) Date of Patent: Dec. 10, 2019

(54) COOKTOP APPLIANCE HAVING A REIGNITION SPARK MODULE

(71) Applicant: Haier US Appliance Solutions, Inc., Wilmington, DE (US)

(72) Inventors: David William Billman, Louisville, KY (US); John Thurl Pottenger, Mount Washington, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 299 days.

(21) Appl. No.: 15/270,028

(22) Filed: Sep. 20, 2016

(65) Prior Publication Data

US 2018/0080657 A1 Mar. 22, 2018

(51) Int. Cl.
*F24C 3/10* (2006.01)
*F24C 3/12* (2006.01)

(52) U.S. Cl.
CPC ..... *F24C 3/103* (2013.01); *F24C 3/122* (2013.01)

(58) Field of Classification Search
CPC ..... F24C 3/102; F24C 3/122
USPC ..... 126/39 E
See application file for complete search history.

(56) References Cited

U.S. PATENT DOCUMENTS

| | | | | |
|---|---|---|---|---|
| 3,218,401 | A * | 11/1965 | Root | H01H 21/02 200/11 C |
| 3,502,835 | A * | 3/1970 | Batcheller | H01H 1/18 200/469 |
| 4,626,196 | A | 12/1986 | Stohrer, Jr. | |
| 4,788,415 | A * | 11/1988 | Whipple, Jr. | F24C 15/106 219/483 |
| 8,436,279 | B2 | 5/2013 | Cadima et al. | |
| 8,928,187 | B2 | 1/2015 | Hamm et al. | |
| 2012/0125910 | A1* | 5/2012 | Shaffer | H01H 19/62 219/262 |

* cited by examiner

*Primary Examiner* — Steven B McAllister
*Assistant Examiner* — Allen R Schult
(74) *Attorney, Agent, or Firm* — Dority & Manning, P.A.

(57) ABSTRACT

A cooktop appliance includes a control valve, a spark generator, and a spark switch. The control valve includes a rotatable member for controlling gas flow rates to a burner assembly of the cooktop appliance. The spark generator provides a spark to ignite gas in the burner assembly. The spark switch may be mounted to the control valve, and may include a rotor fixedly mounted to the rotatable member. The rotor may be rotatable between an initial position and a first position. In the initial position, the spark generator does not receive electrical power. In the first position, the spark generator does receive electrical power. The spark generator may be configured to introduce a time delay between receiving electrical power and providing the spark to ignite gas in the burner assembly.

8 Claims, 12 Drawing Sheets

COOKTOP APPLIANCE HAVING A REIGNITION SPARK MODULE

FIELD OF THE INVENTION

The present subject matter relates generally to cooktop appliances, such as gas cooktop appliances. More particularly, the present subject matter relates to a gas cooktop appliance having a reignition spark module.

BACKGROUND OF THE INVENTION

Gas cooktop appliances generally include multiple gas burners mounted to a top panel. Certain gas cooktop appliances include electric ignition systems that include, among other things, a reignition spark module. In general, the reignition spark module may be located underneath a top panel of the cooktop appliance or, alternatively, may be mounted to a back panel of the cooktop appliance. The reignition spark module may also be electrically connected to one or more spark switches. Each spark switch may be mounted on a rotatable member of a burner control knob, and may generate an electrical signal when a user rotates the burner control knob by a predetermined amount. When this occurs, the reignition spark module may ignite a gas burner associated with the burner control knob rotated by the user.

When the cooktop appliance is powered on, the reignition spark module continuously draws electrical power from a power supply of the cooktop appliance. As such, the reignition spark module draws electrical power even when none of the gas burners are ignited. In such an instance, the power drawn by the reignition spark module is referred to as standby power, which is essentially unused power. If the standby power consumption of a device is relatively high, a consumer's utility bill may be negatively impacted.

Accordingly, a cooktop appliance with features for reducing or eliminating standby power consumption of a reignition spark module would be useful.

BRIEF DESCRIPTION OF THE INVENTION

Aspects and advantages of the invention will be set forth in part in the following description, or may be obvious from the description, or may be learned through practice of the invention.

In a first exemplary embodiment, a cooktop appliance includes a control valve, a spark generator, and a spark switch. The control valve includes a rotatable member for controlling gas flow rates to a burner assembly of the cooktop appliance. The spark generator is configured to provide a spark to ignite gas in the burner assembly. The spark switch may be mounted to the control valve. In addition, the spark switch may include a rotor fixedly mounted to the rotatable member of the control valve. The rotor may be rotatable between an initial position and a first position. When the rotor is in the initial position, the spark generator does not receive electrical power. However, when the rotor is in the first position, the spark generator does receive electrical power. Further, the spark generator may be configured to introduce a time delay between receiving electrical power and providing the spark to ignite gas in the burner assembly.

In a second exemplary embodiment, a cooktop appliance includes a control valve, a spark generator, and a spark switch. The control valve includes a rotatable member for controlling gas flow rates to a burner assembly of the cooktop appliance. The spark generator is configured to provide a spark to ignite gas in the burner assembly. The spark switch may be mounted to the control valve. In addition, the spark switch may include a rotor, a first switch, and a second switch that is spaced apart from the first switch. The rotor may be fixedly mounted to the rotatable member of the control valve. Additionally, the rotor may be rotatable to a first position and a second position. In the first position, a first electric current flows from a power supply of the cooktop appliance to the spark generator via the first switch. In the second position, a second electric current flows from the power supply to the spark generator via the second switch.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
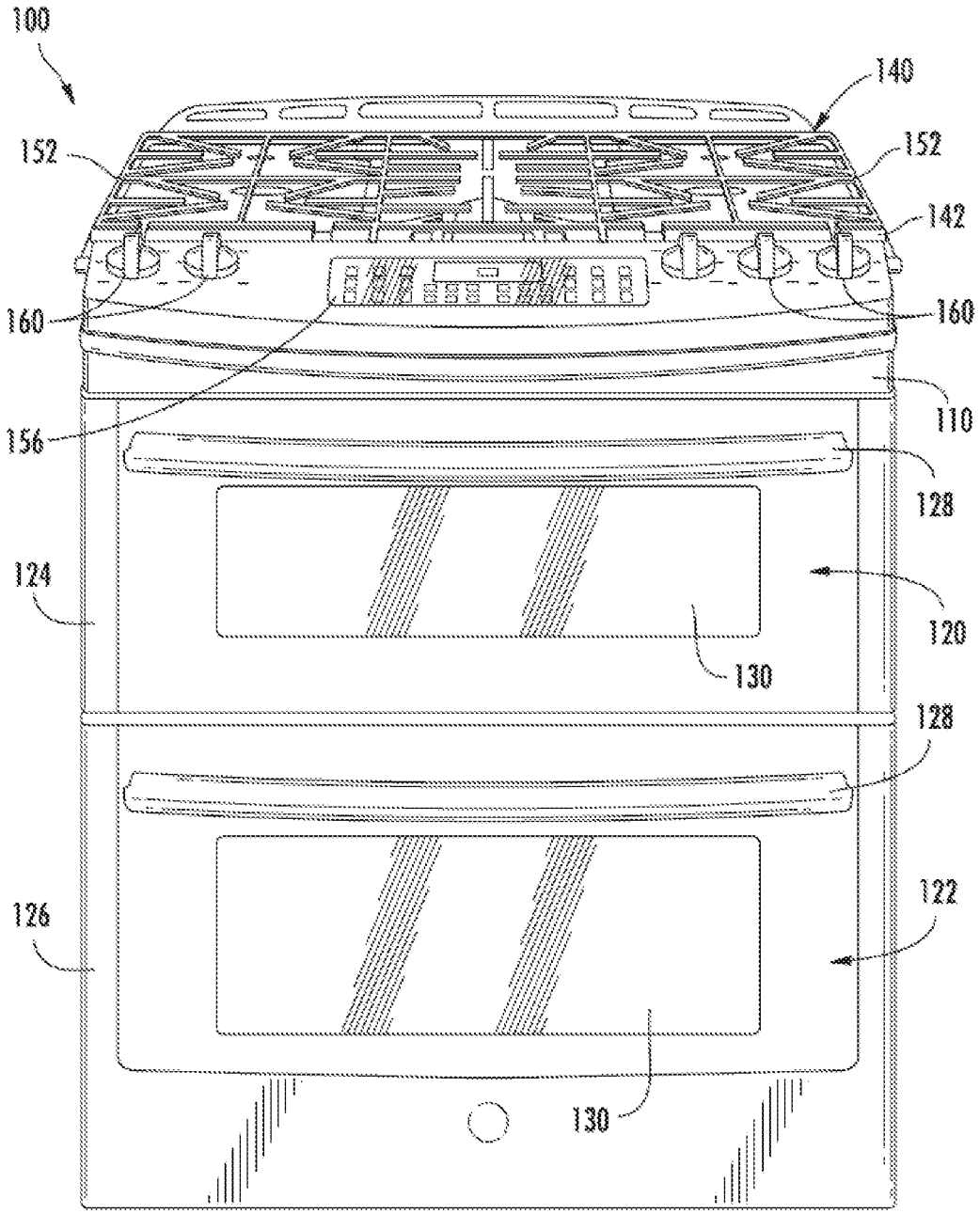
FIG. 1 provides a front, perspective view of a range appliance according to embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
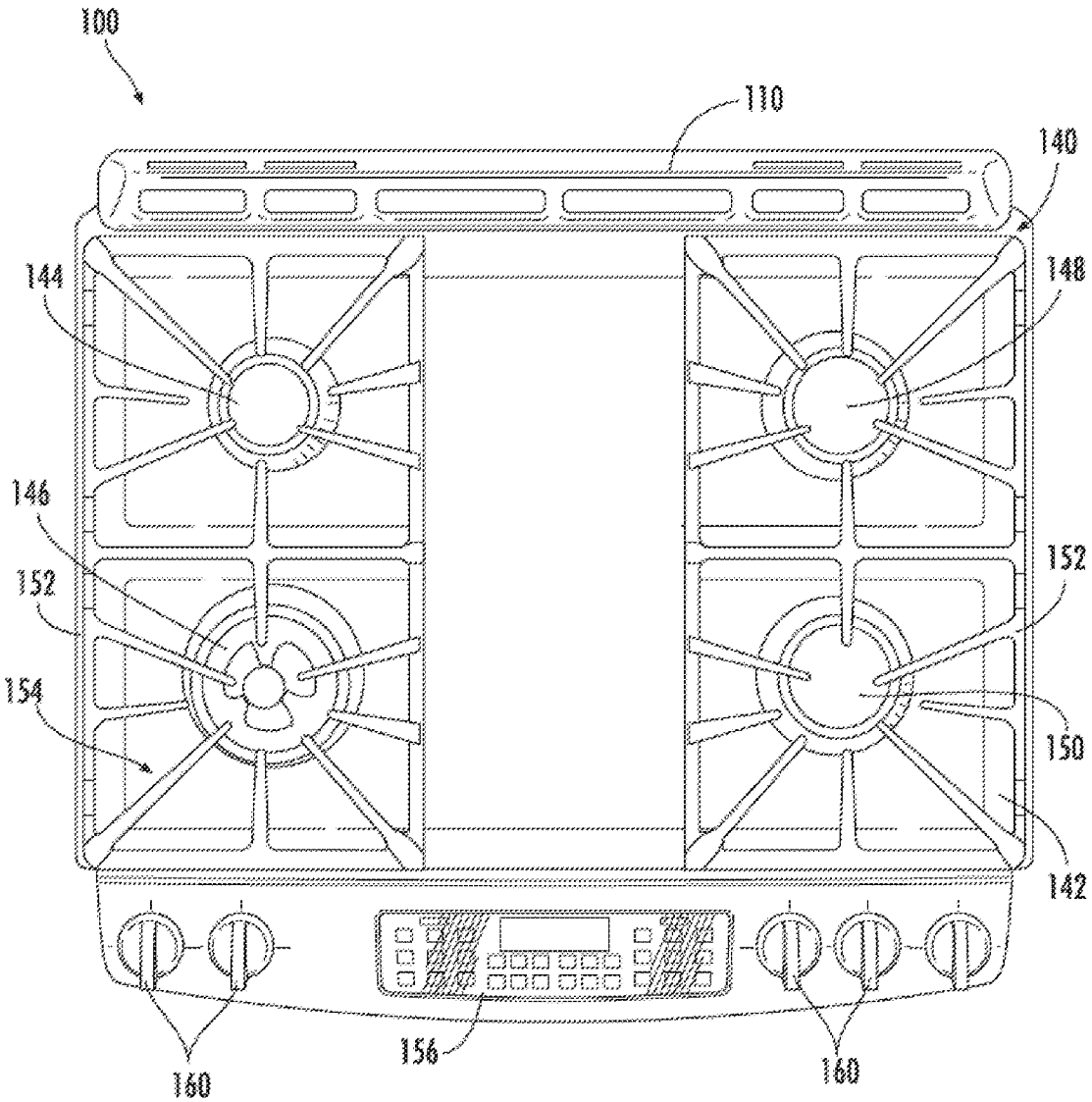
FIG. 2 provides a top view of the exemplary range appliance of FIG. 1.

FIG. 1 provides a front, perspective view of a range appliance 100 as may be employed with the present disclosure. FIG. 2 provides a top, plan view of range appliance 100. Range appliance 100 includes an insulated cabinet 110. Cabinet 110 defines an upper cooking chamber 120 and a lower cooking chamber 122. Thus, the range appliance 100 is generally referred to as a double oven range appliance. As will be understood by those skilled in the art, the range appliance 100 is provided by way of example only, and the present disclosure may be used in any suitable range appliance, e.g., a single oven range appliance or a standalone cooktop appliance. Thus, the embodiment shown in FIG. 1 is not intended to limit the present subject matter to any particular cooking chamber position or arrangement.

Upper and lower cooking chambers 120 and 122 are configured for the receipt of one or more food items to be cooked. The range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass window panes 130 provide for viewing the contents of upper and lower cooking chambers 120 and 122 when doors 124 and 126 are closed and also assist with insulating upper and lower cooking chambers 120 and 122. Heating elements, such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

The range appliance 100 also includes a cooktop 140. The cooktop 140 is positioned at or adjacent a top portion of cabinet 110. Thus, the cooktop 140 is positioned above the upper and lower cooking chambers 120 and 122. The cooktop 140 includes a top panel 142. By way of example, the top panel 142 may be constructed of glass, ceramics, enameled steel, and combinations thereof.

For the range appliance 100 of FIG. 1, a utensil holding food and/or cooking liquids (e.g., oil, water, etc.) may be placed onto grates 152 at a location of any of the burner assemblies 144, 146, 148, 150. The burner assemblies 144, 146, 148, 150 provide thermal energy to cooking utensils on the grates 152. As shown in FIG. 1, the burners assemblies 144, 146, 148, 150 can be configured in various sizes so as to provide e.g., for the receipt of cooking utensils (i.e., pots, pans, etc.) of various sizes and positions and to provide different heat inputs for such cooking utensils. The grates 152 are supported on a top surface 154 of the top panel 142.

A user interface panel 156 is located within convenient reach of a user of the range appliance 100. For this embodiment, the user interface panel 156 includes knobs 160 that are each associated with one of the burner assemblies 144, 146, 148, 150. Knobs 160 allow the user to activate each burner assembly and determine the amount of heat input provided by each burner assembly 144, 146, 148, 150 to a cooking utensil located thereon. User interface panel 156 may also be provided with one or more graphical display devices that deliver certain information to the user such as e.g., whether a particular burner assembly is activated and/or the rate at which the burner assembly is set.

Although shown with the knobs 160, it should be understood that the knobs 160 and the position of the range appliance 100 shown in FIG. 1 are provided by way of example only. More specifically, the user interface panel 156 may include various input components, such as one or more of a variety of touch-type controls, electrical, mechanical or electro-mechanical input devices including rotary dials, push buttons, and touch pads, e.g., in addition to the knobs 160. The user interface panel 156 may include other display components, such as a digital or analog display device designed to provide operational feedback to a user.

Figure 3:
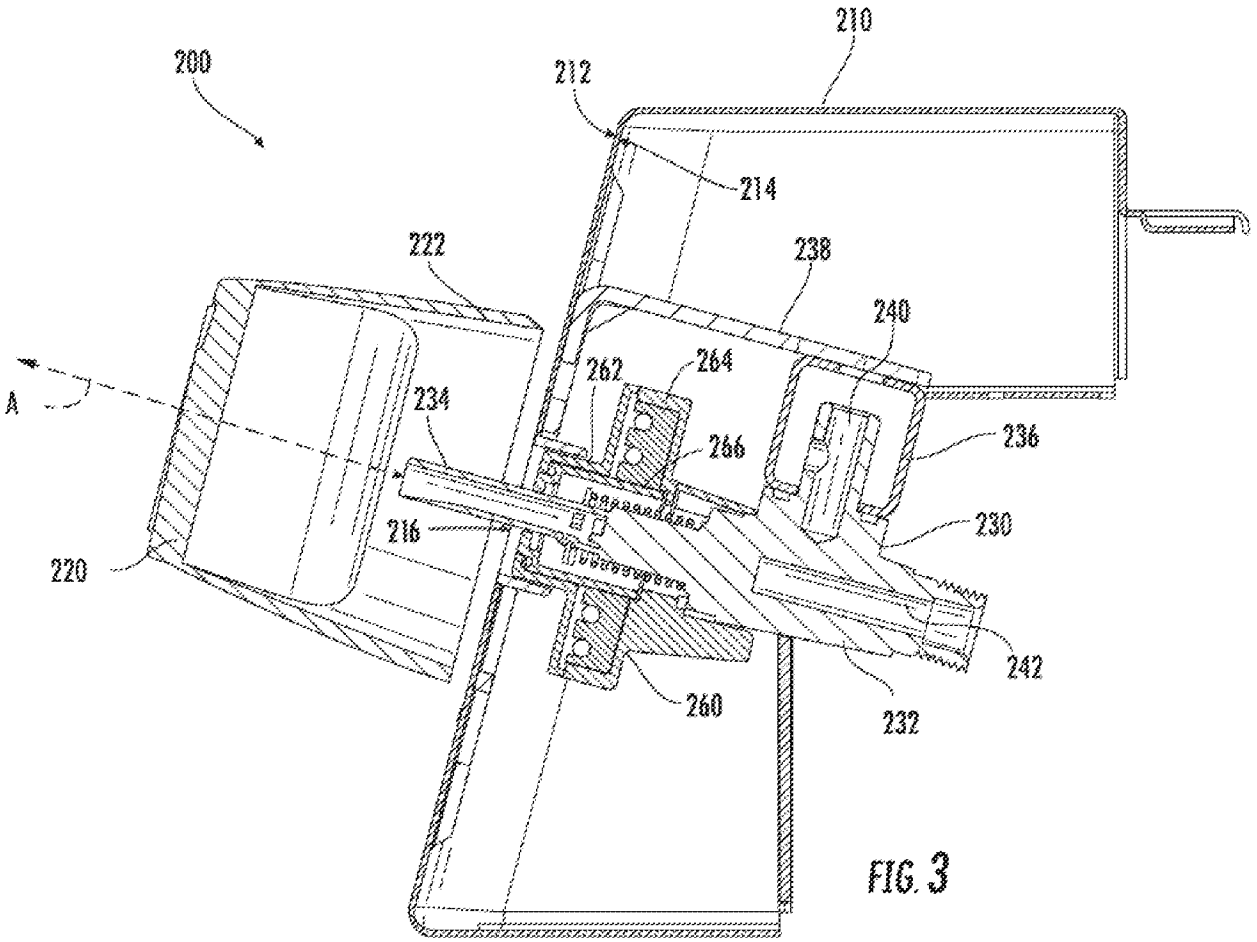
FIG. 3 provides a side, section view of a control panel assembly according to embodiments of the present disclosure and that may be used with the range appliance of FIG. 1.
Figure 4:
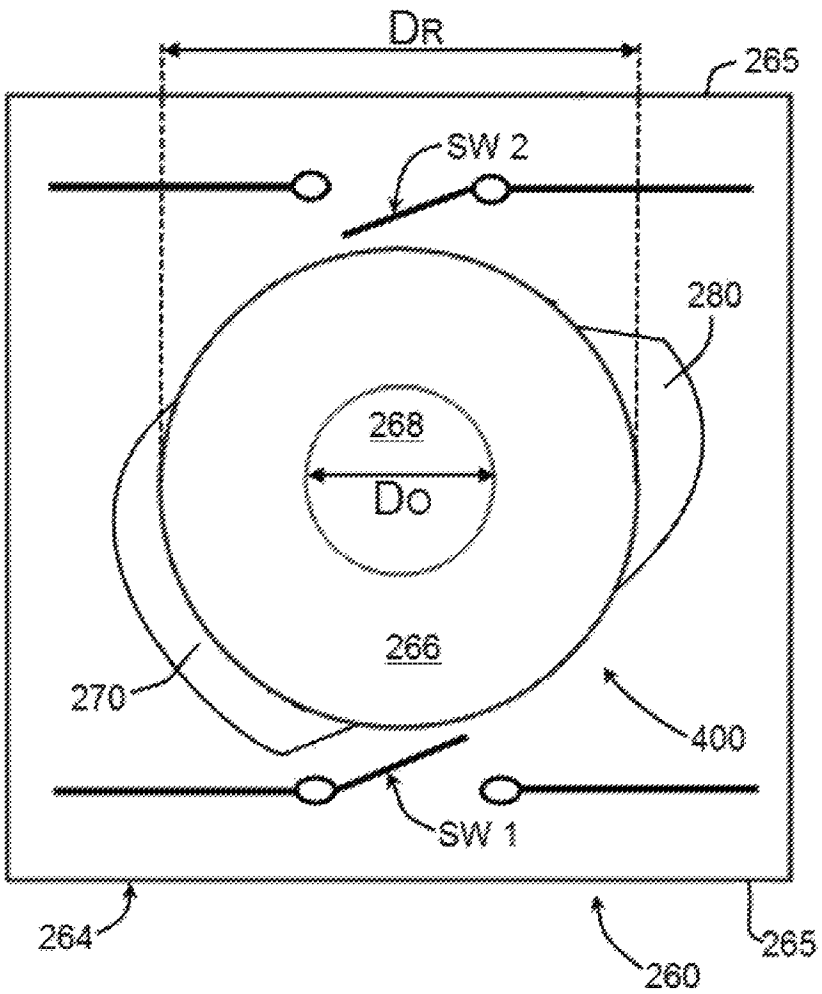
FIG. 4 provides a top, cross-section view of a spark switch according to embodiments of the present disclosure.

FIG. 3 provides a side, elevation view of a control panel assembly 200 according to an embodiment of the present disclosure. FIG. 4 provides a side, section view of the control panel assembly 200. The control panel assembly 200 may be used in or within any suitable cooktop appliance. For example, the control panel assembly 200 may be used in or within range appliance 100. Thus, the control panel assembly 200 is discussed in greater detail below in the context of the range appliance 100.

As may be seen in FIG. 3, the control panel assembly 200 includes a panel 210, a knob 220 (e.g., one of knobs 160) and a control valve 230. The panel 210 may be part of the top panel 142 of the range appliance 100 (FIG. 1) or may be separate from the top panel 142. The panel 210 defines an outer surface 212 and an inner surface 214. The outer and inner surfaces 212, 214 of the panel 210 are positioned opposite each other on the panel 210. For example, the inner surface 214 of the panel 210 may face an interior of the range appliance 100, and the outer surface 212 of the panel 210 may face away from the interior of the range appliance 100. The panel 210 also defines an opening 216. The opening 216 of the panel 210 extends through the panel 210, e.g., between the outer and inner surfaces 212, 214 of the panel 210.

The knob 220 and control valve 230 are positioned at or adjacent the opening 216 of the panel 210. As an example, the knob 220 and the control valve 230 may be positioned opposite each other about the panel 210. In particular, the knob 220 may be positioned at or adjacent the outer surface 214 of the panel 210 proximate the opening 216 of the panel 210, and the control valve 230 may be positioned at or adjacent the inner surface 214 of the panel 210 proximate the opening 216 of the panel 210.

The control valve 230 may include, for example, a valve body 232, a rotatable member 234, a manifold 236, a manifold bracket 238, an inlet 240, and an outlet 242. The valve body 232 may be configured for housing various components of the control valve 230 that regulate a flow of gaseous fuel, such as propane or natural gas, from the manifold 236 to the inlet 240. In particular, the control valve 230 is selectively adjustable between an open position and a closed position. In the closed position, the control valve 230 blocks gaseous fuel flow from the manifold 236 to the inlet 240. Conversely, in the open position, the control valve 230 permits gaseous fuel flow from the manifold 236 to the inlet 240. The rotatable member 234 extends from the valve body 232 through the panel 210 at the opening 216 of the panel 210. The knob 220 is coupled to (e.g., mounted to) the rotatable member 234. A user may rotate the knob 220 in order to adjust the control valve 230 between the open and closed positions. The outlet 242 of the control valve 230 extends from the valve body 232 to one of the burner assemblies 144, 146, 148, 150 in order to supply fuel from the valve body 232 thereto. In one embodiment, a gas tube may be coupled to the outlet 242. More specifically, the gas tube may extend between the outlet and one of the burner assemblies 144, 146, 148, 150.

The control valve 230 may be mounted to the panel 210. For example, the manifold 236 may be connected to the valve body 232 at the inlet 240 of the valve body 232, and the manifold bracket 238 may be mounted (e.g., fastened) to the panel 210. The manifold 236 may be mounted to (e.g., fastened) to the manifold bracket 238. In such a manner, the control valve 230 may be connected and mounted to the panel 210.

The control panel assembly 200 also includes a spark switch 260. The spark switch 260 may be mounted to the control valve 230. For example, a switch housing 264 of the spark switch 260 may be mounted to the valve body 232 such that the switch housing 264 of the spark switch 260 is fixed relative to the valve body 232. Conversely, a rotor 266 of the spark switch 260 may be fixedly mounted to the rotatable member 234 such that the rotor 266 of the spark switch 260 is fixed relative to the rotatable member 234. The knob 220 may be positioned opposite the spark switch 260 about the panel. By coupling the rotor 266 of the spark switch 260 to the rotatable member 234, the rotor 266 of the spark switch 260 may rotate within the switch housing 264 when a user rotates the knob 220.

As will be discussed below in more detail, the spark switch 260 is configured for electrically connecting a power supply of the range appliance 100 to an igniter (e.g., electrode) at one of the burner assemblies 144, 146, 148, 150. In particular, the spark switch 260 may be configured for closing an electrical circuit to the igniter when a user rotates knob 220 such that the control valve 230 is in the open position, and the spark switch 260 may be configured for opening the electrical circuit when the user rotates the knob 220 such that the control valve 230 is in the closed position. In such a manner, the spark switch may assist with igniting gaseous fuel at burners of the range appliance 100.

FIG. 4 provides a top-down view of the spark switch 260 with a top cover removed. As shown, the rotor 266 generally defines a maximum diameter $D_R$, and is disposed within the switch housing 264. The rotor 266 further defines an opening 268 having a maximum diameter $D_O$. It should be appreciated that the maximum diameter $D_O$ of the opening 268 is different than the maximum diameter $D_R$ of the rotor 266. Specifically, the maximum diameter $D_R$ of the rotor 266 is greater than the maximum diameter $D_O$ of the opening 268. It should also be appreciated that the rotatable member 234 (FIG. 3) may extend through the opening 268. Accordingly, the rotatable member 234 and the rotor 266 may rotate together relative to the switch housing 264.

The housing 264 defines an opening through which the rotatable member 234 extends. More specifically, the opening of the housing 264 may be aligned with the opening 268 of the rotor 266 such that the rotatable member 234 may extend through the opening of the housing 264 and the opening 268 of the rotor 266. Further, the opening of the housing 264 may define a diameter that is substantially similar to the diameter $D_O$ of the opening 268 defined by the rotor 266.

The rotor 266 may further include a first cam 270 and a second cam 280. The first and second cams 270, 280 may each extend outwardly from a perimeter of the rotor 266. Further, the first cam 270 may be spaced apart from the second cam 280 along the perimeter of the rotor 266. In particular, the first cam 270 may extend along a first portion of the perimeter, and the second cam 280 may extend along a second portion of the perimeter. In embodiments of the present disclosure, the first portion may be different than the second portion. More specifically, the first portion may be greater than the second portion. As will be discussed below in more detail, the first and second cams 270, 280 may each rotate with the rotor 266, and may each be used to move one or more switches between an open configuration and a closed configuration.

Figure 5:
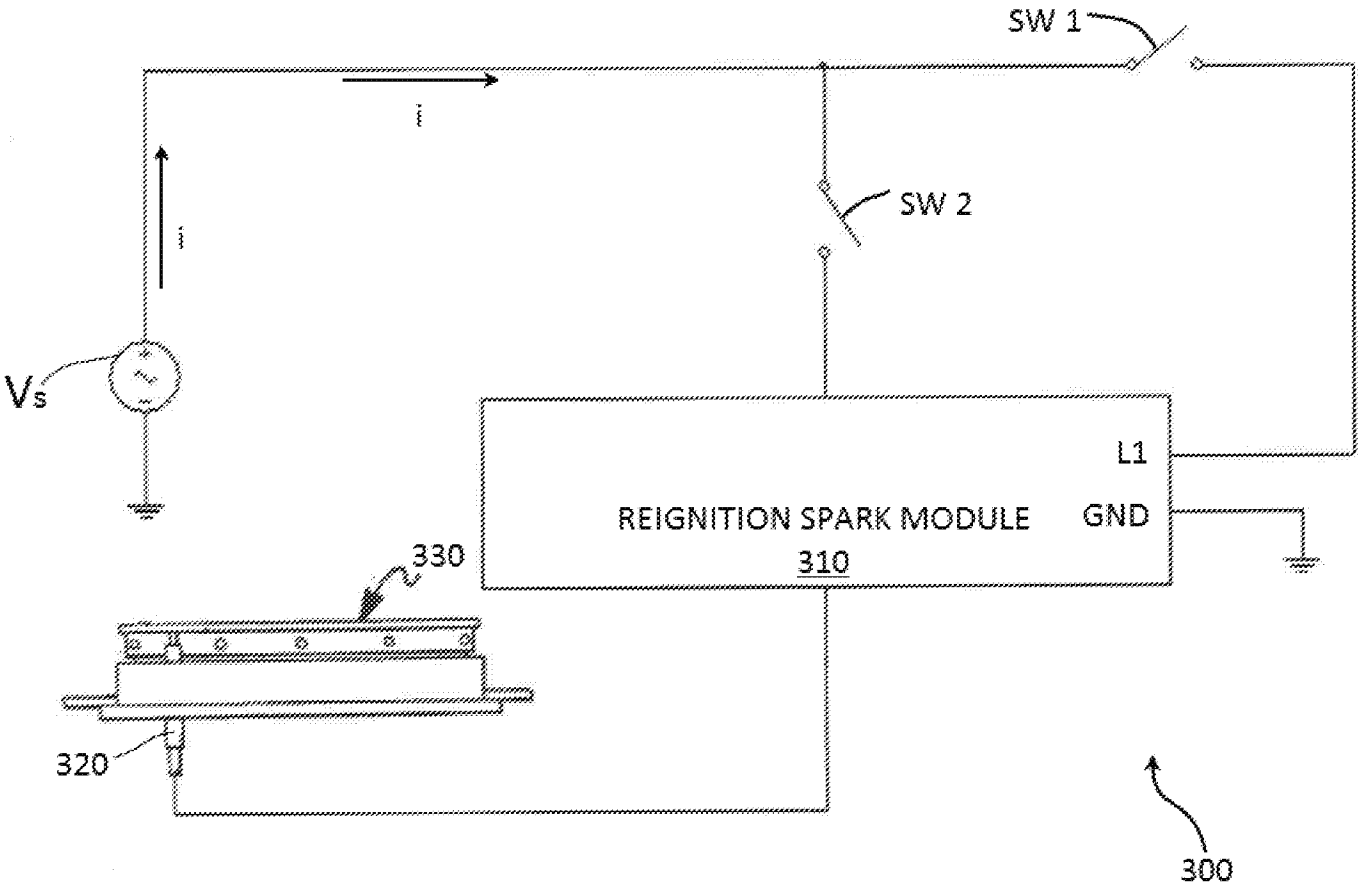
FIG. 5 provides a schematic of a spark generator according to embodiments of the present disclosure.

The spark switch 260 also includes a first switch SW 1 and a second switch SW 2. As shown in FIG. 5, the first and second switches SW 1 and SW 2 are each disposed within the switch housing 264 of the spark switch 260. More specifically, the first and second switches SW 1, SW 2 may be positioned at opposing sides 265 of the switch housing 264. In FIG. 4, the first and second switches SW 1 and SW 2 are both illustrated in the open position. As the rotor 266 rotates, the first cam 270 may contact the first switch SW 1, and the second cam 280 may contact the second switch SW 2. More specifically, the first cam 270 may contact the first switch SW 1 to move the first switch SW 1 from the open position to the closed position. Likewise, the second cam 280 may contact the second switch SW 2 to move the second switch SW 2 from the open position to the closed position. As will be discussed below in more detail, the first and second switches SW 1, SW 2 may be used to control the operation of a spark generator for a cooking appliance.

FIG. 5 provides a schematic view of a spark generator 300 in accordance with the present subject matter. In general, the spark generator 300 will be described with reference to the range appliance 100 and the control panel assembly 200 described above with reference to FIGS. 1-3. The spark generator 300 may include a reignition spark module 310 and a spark electrode 320. The reignition spark module 310 may be positioned beneath the top panel 142 of the range appliance 100. Alternatively, the reignition spark module 310 may be mounted on a back panel of the range appliance 100. The reignition spark module 310 may include a transformer configured to step-up (e.g., increase) a voltage produced by a power supply Vs of the range appliance 100. Further, the reignition spark module 310 may include an input voltage terminal $L_1$, a ground terminal GND, and a reignite terminal REIG. It should be appreciated that the reignition spark module 310 may include additional terminals. For example, the reignition spark module 310 may include additional reignite terminals for range appliances having more than one burner assembly.

The voltage potential between the input voltage terminal L1 and the ground terminal GND indicates a voltage across the reignition spark module 310, which provides indicia as to whether the reignition spark module 310 is drawing power from the voltage source $V_S$. The voltage potential between the reignite terminal REIG and the ground terminal GND provides indicia as to whether the reignition spark module 310 is outputting the stepped-up voltage. As will be discussed below in more detail, the user controls the operation of the reignition spark module 310 through rotation of the knob 220.

It should be appreciated that the power supply Vs may be an alternating current (AC) power source. Alternatively, the power supply Vs may be a direct current (DC) voltage from a DC power source. In yet another embodiment, the power supply Vs may be a DC voltage that has been converted from the AC power source.

The spark electrode 320 may be positioned adjacent to a burner base 330. Specifically, the spark electrode 320 may be positioned within a flow path of gaseous fuel flowing from a gas tube that is in fluid communication with the outlet 242 (FIG. 3). The gas tube may emit the gaseous fuel directly beneath the burner base 330. Further, the spark electrode 320 may receive the stepped-up voltage outputted from the reignition spark module 310, and a spark may be produced between the burner base 330 and the spark electrode 320. More specifically, the spark may occur within the flow path and, as a result, may ignite the gaseous fuel. Accordingly, the ignited fuel may heat the base burner 330. It should be appreciated that the base burner 330 may be a component of the burner assemblies 144, 146, 148, 150 illustrated in FIG. 1.

As will be discussed below in more detail, the rotor 266 may rotate between an initial position, a first position, and a second position. In the initial position, the spark generator 300 does not consume electrical power. However, when the rotor 266 is rotated to the first position, the spark generator 300 receives electrical power from the power supply $V_S$ of the range appliance 100. Further, when the rotor 266 is rotated to the second position, the spark generator 300 generates the spark necessary to ignite one or more of the base burners 330 which, as mentioned above, may be a component of the burner assemblies 144, 146, 148, 150 shown in FIG. 1.

Referring now to FIGS. 4 and 5 in combination, the rotor 266 of the spark switch 260 is shown in an initial position 400 in which the first and second switches SW 1 and SW 2 are both in the open position. Thus, neither the first switch SW 1 nor the second switch SW 2 provide an electrical path for a current (i) to flow from a power supply $V_S$ to the reignition spark module 310. Specifically, the reignition spark module 310 does not draw electrical power from the power supply Vs when the rotor 266 is in the initial position 400, because the first switch SW 1 does not provide a closed electrical path between the voltage source $V_S$ and the input terminal L1 of the reignition spark module 310. Accordingly, the reignition spark module 310 does not consume electrical power when the rotor 266 is in the initial position 400.

Figure 6:
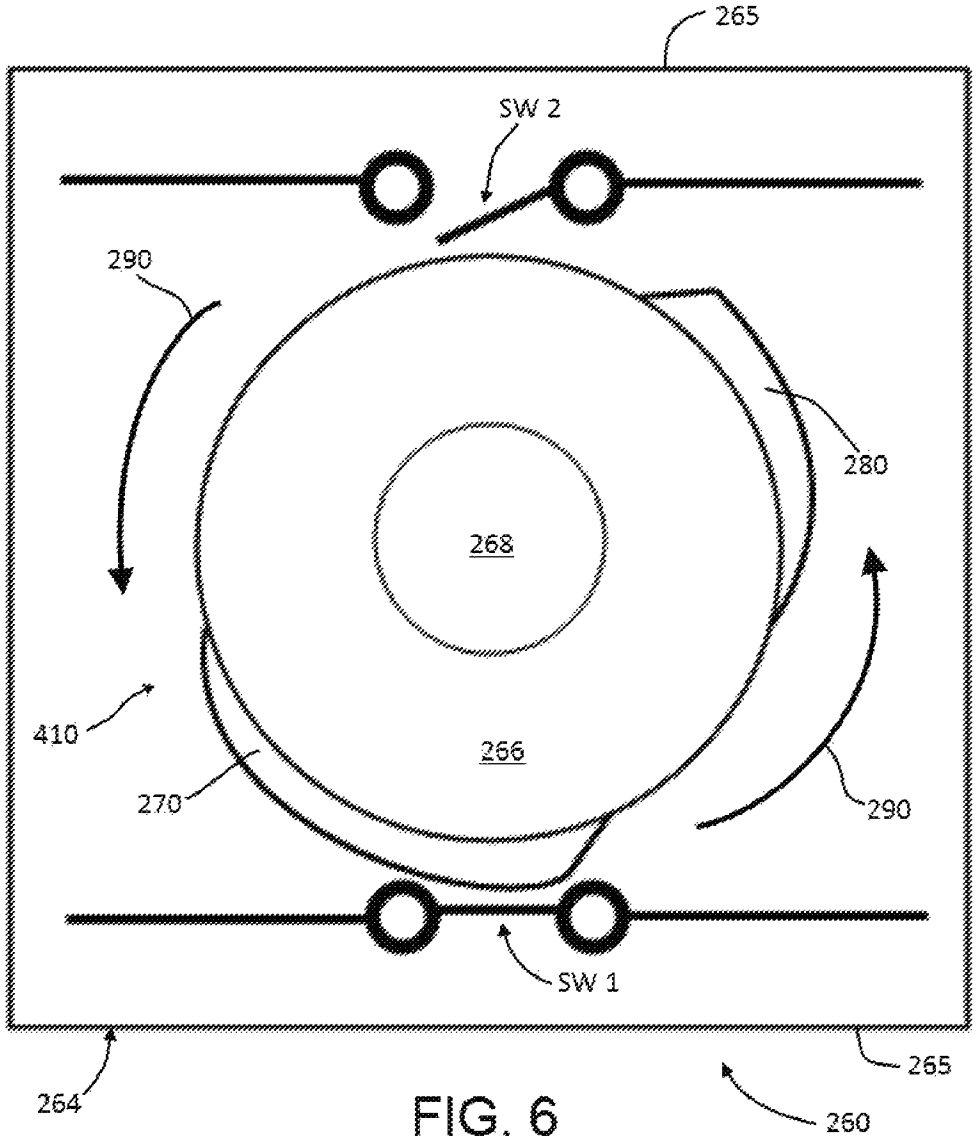
FIG. 6 provides a top, cross-section view of the spark switch of FIG. 4 rotated to first position.
Figure 7:
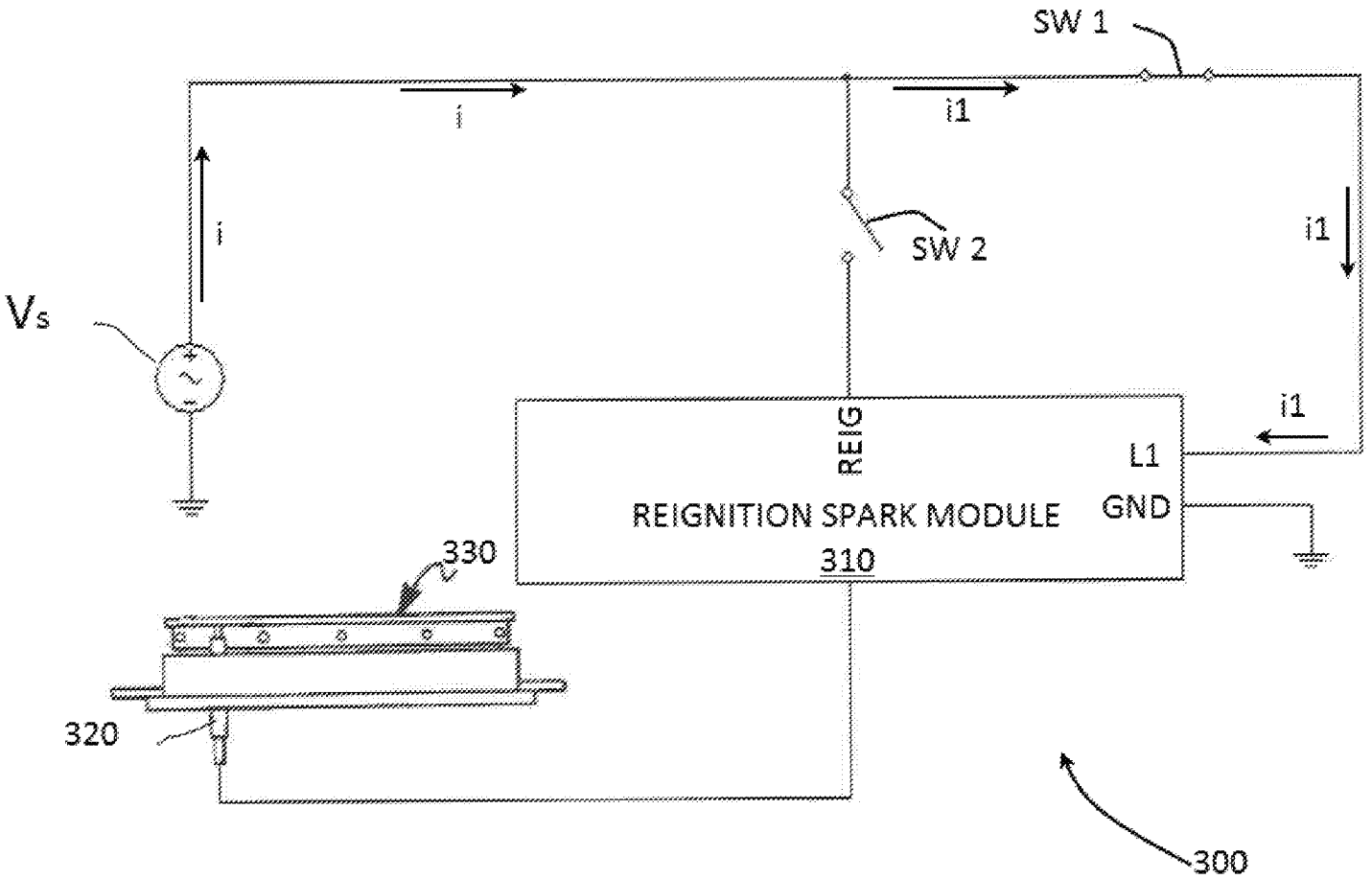
FIG. 7 provides a circuit diagram indicating operation of the spark generator of FIG. 5 when the spark switch is in the first position.

Referring now to FIGS. 6 and 7, the rotor 266 of the spark switch 260 is shown in a first position 410. More specifically, the rotor 266 rotates from the initial position 400 (FIG. 4) to the first position 410 along a first direction 290. In the first position 410, the first cam 270 of the rotor 266 contacts the first switch SW 1. Specifically, the first cam 270 moves the first switch SW 1 from the open position (FIG. 4) to the closed position shown in FIG. 6. In the closed position, the first switch SW 1 provides a closed electrical path between the power supply $V_S$ and the reignition spark module 310. Specifically, the current (i) flows from the power supply $V_S$ to the input terminal L1 of the reignition spark module 310. Thus, the reignition spark module 310 consumes electrical power when the rotor 266 is in the first position 410.

In contrast to the first switch SW 1, the second switch SW 2 remains in the open position when a user rotates the rotor 266 of the spark switch 260 to the first position 410. Thus, the second switch SW 2 does not provide a closed electrical path between the power supply $V_S$ and the reignition spark module 310. Specifically, the second switch SW 2 does not provide a closed electrical path between the power supply $V_S$ and the reignite terminal REIG of the reignition spark module 310. As such, the base burner 330 does not ignite when the rotor 266 is in the first position 410, because the reignition spark module 310 does not output the stepped-up voltage to the spark electrode 320.

Figure 8:
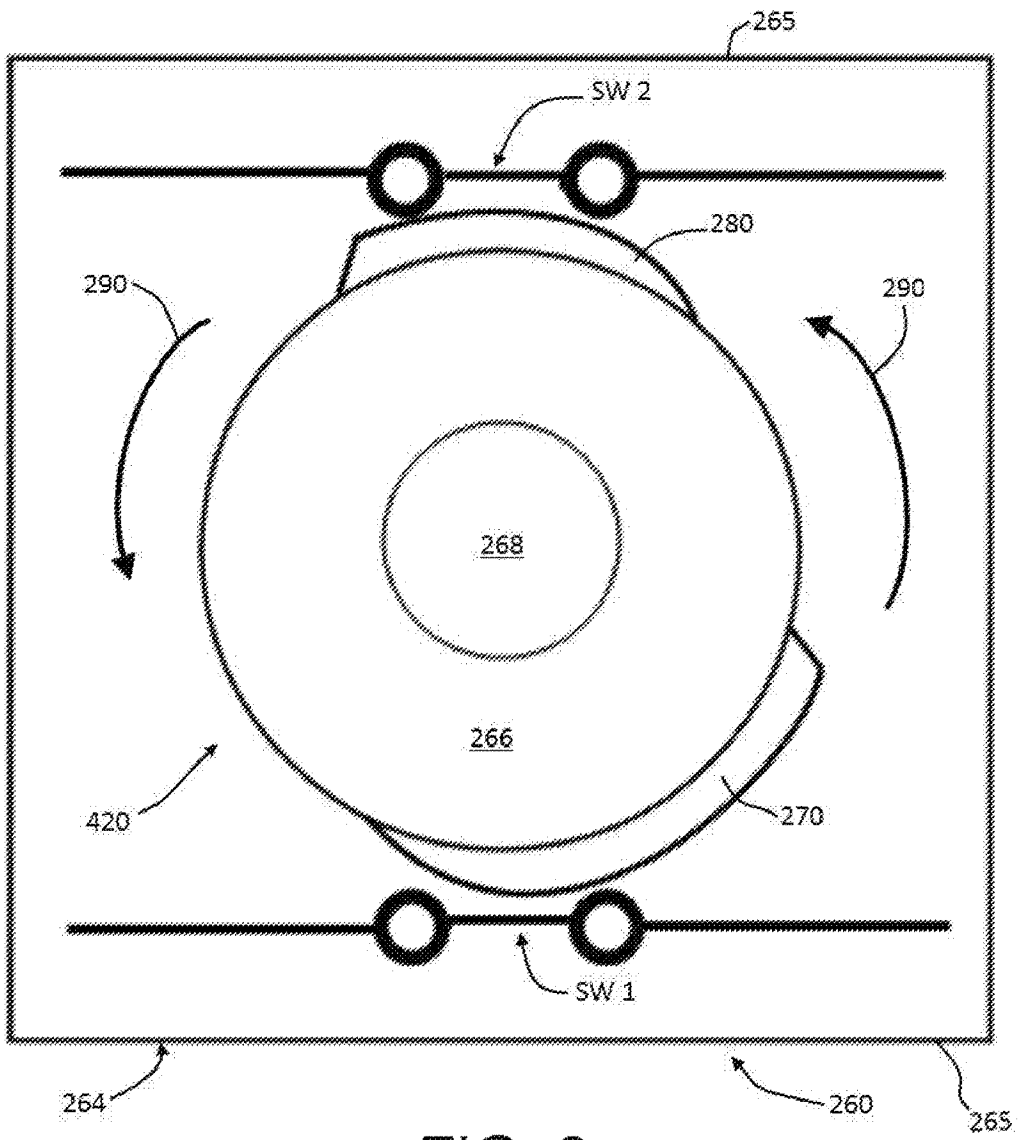
FIG. 8 provides a top, cross-section view of the spark switch of FIG. 4 rotated to a second position.
Figure 9:
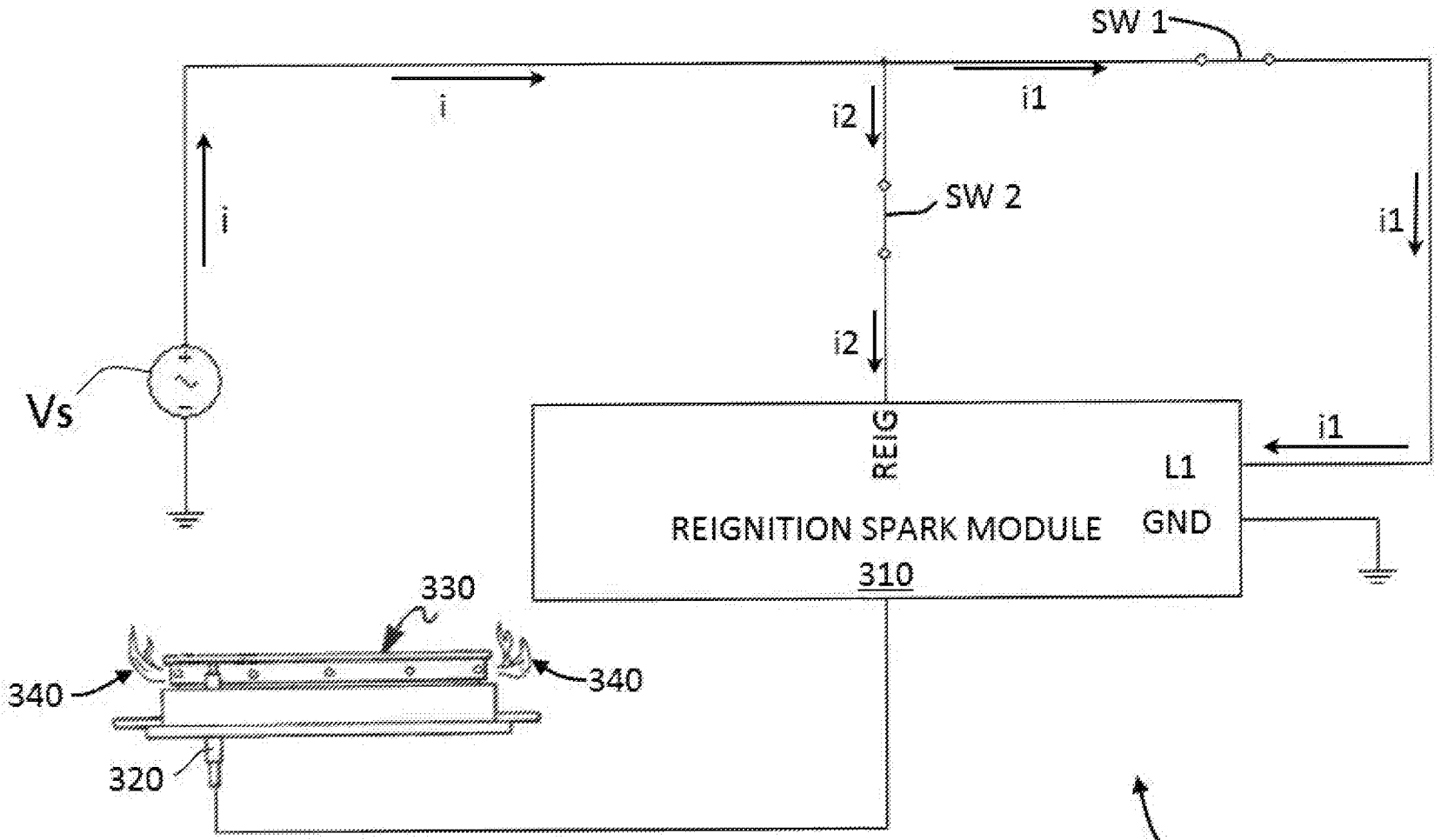
FIG. 9 provides a circuit diagram indicating the operation of the spark generator of FIG. 5 when the spark switch is in the second position.

Referring now to FIGS. 8 and 9, the rotor 266 of the spark switch 260 is shown in a second position 420. More specifically, the rotor 266 rotates from the first position 410 (FIG. 6) to the second position 420 along the first direction 290. It should be appreciated that the rotor 266 may rotate by any suitable amount when the rotor 266 is rotated from the first position 410 to the second position 420. As an example, the rotor 266 may rotate between 12 and 23 degrees when the rotor 266 rotates from the first position 410 to the second position 420.

In the second position 420, the first switch SW 1 remains in the closed position, because the first cam 270 continues to contact the first switch SW 1. Further, the second cam 280 of the rotor 266 contacts the second switch SW 2. Specifically, the second switch SW 2 moves from the open position to the closed position. Accordingly, both the first and second switches SW 2 are in the closed position when the rotor 266 is in the second position 420.

With both the first and second switches SW 1 and SW 2 in the closed position, the current (i) flowing from the power supply $V_S$ branches into a first electric current (i1) and a second electric current (i2). The first electric current (i1) flows through the first switch SW 1 to the input terminal L1 of the reignition spark module 310. The second electric current (i2) flows through the second switch SW 2 to the reignite terminal REIG of the reignition spark module 310. Thus, the reignition spark module 310 consumes electrical power and outputs the stepped-up voltage when the rotor 266 is in the second position 420. As such, the spark electrode 320 emits the stepped-up voltage, which generates the spark necessary to ignite the gaseous fuel at the base burner 330.

Figure 10:
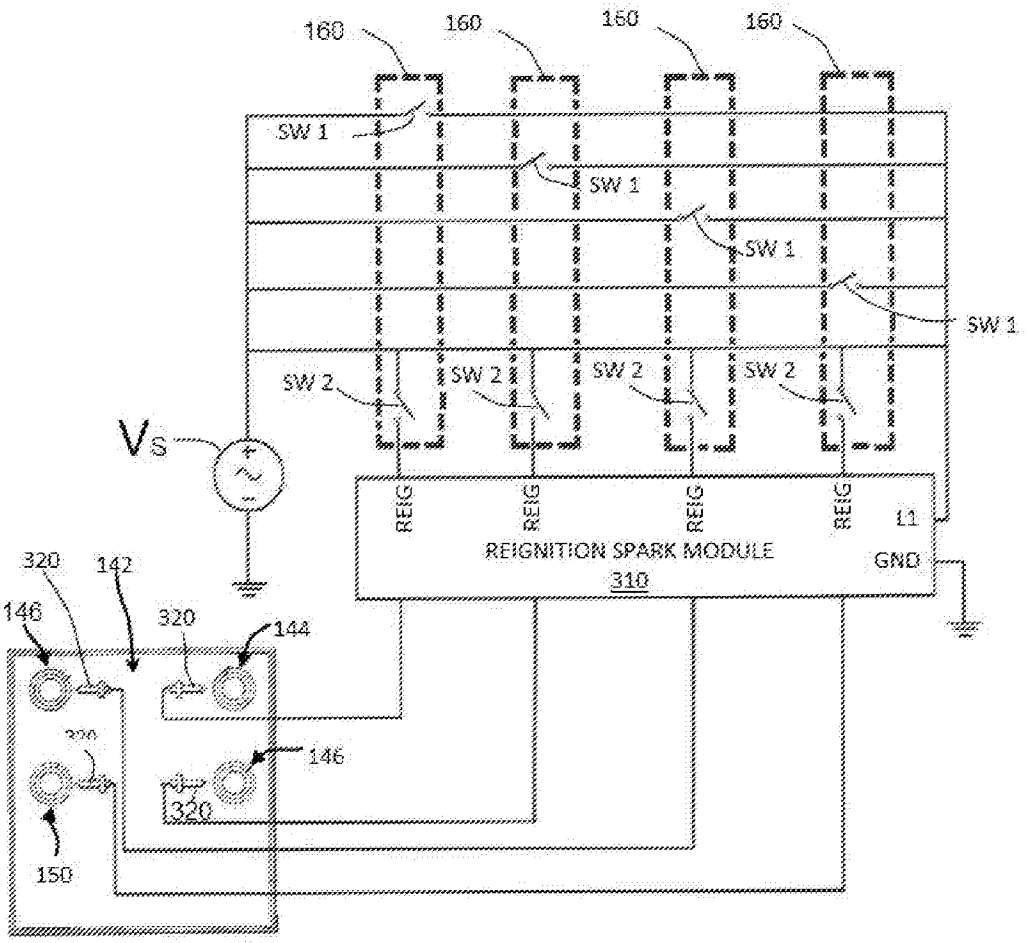
FIG. 10 provides a circuit diagram indicating another embodiment of the spark generator in accordance with the present disclosure.

Referring now to FIG. 10, another embodiment of the spark generator 300 is illustrated in which the reignition spark module 310 includes additional inputs, specifically additional reignite terminals REIG, to accommodate additional knobs 160 of the range appliance 100. Further, the reignition spark module 310 includes additional outputs such that the reignition spark module 310 is in electrical communication with additional spark electrodes 320 positioned adjacent to each of the additional burner assemblies 146, 148, 150. The reignition spark module 310 and spark electrode 320 may be used in substantially the same manner as described above to ignite the gas at one or more of the burner assemblies 144, 146, 148, 150 to produce a flame 340. It should be appreciated that that the spark generator 300 may accommodate a range appliance 100 having any suitable number of knobs 160.

Figure 11:
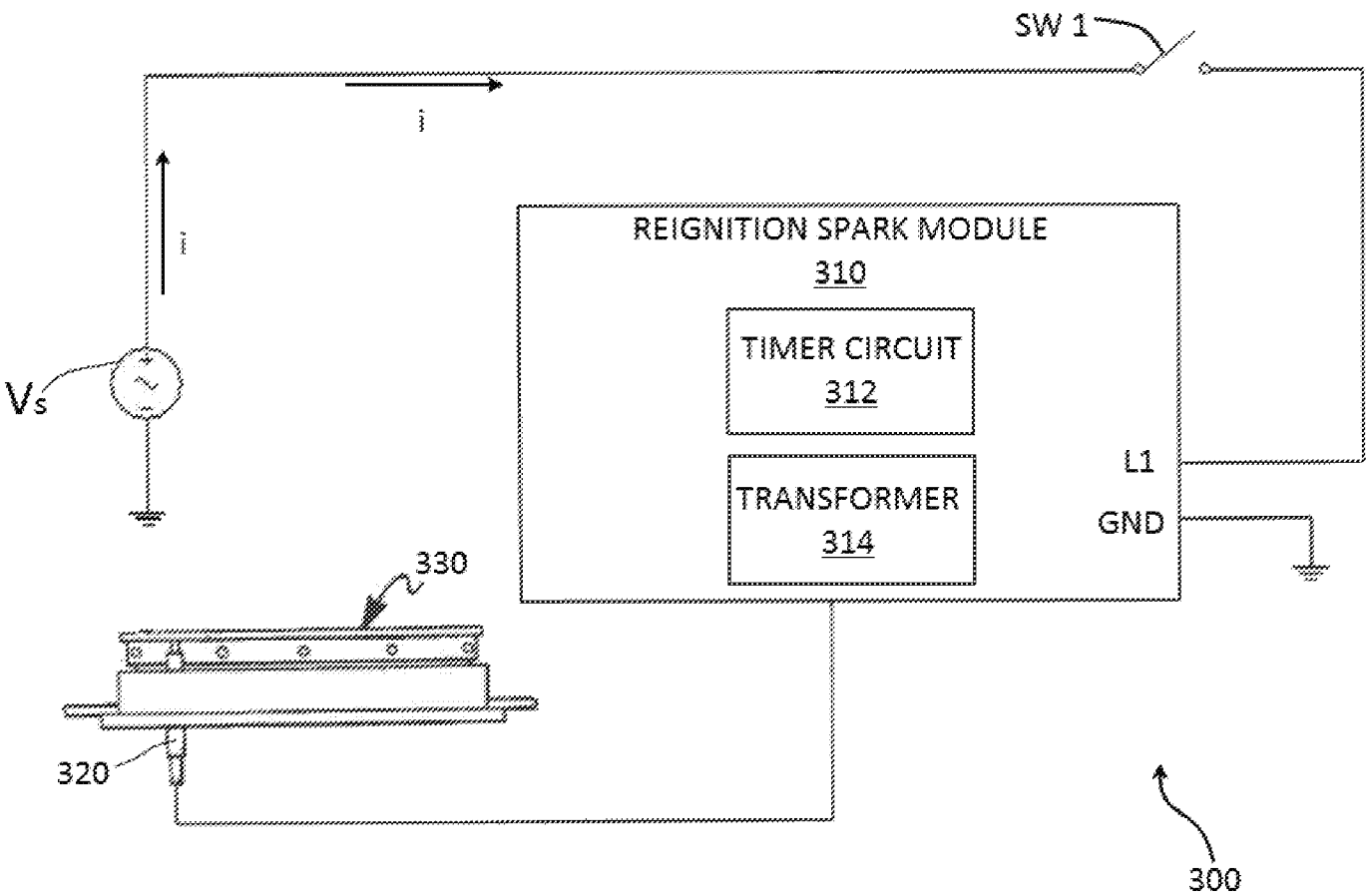
FIG. 11 provides a circuit diagram indicating yet another embodiment of the spark generator in accordance with the present disclosure.

Referring now to FIG. 11, yet another embodiment of the spark generator 300 is illustrated in accordance with the present disclosure. The exemplary spark generator 300 depicted in FIG. 11 may be configured in substantially the same manner as the exemplary spark generator 300 depicted in FIG. 5, and accordingly, the same or similar numbers may refer to the same or similar parts. For example, the spark generator includes a reignition spark module 310 and a spark generator 320.

However, for the embodiment of FIG. 11, the spark module 310 includes a timer circuit 312. In particular, the timer circuit 312 is in electrical communication with the input terminal L1 and a transformer 314. More specifically, the input side of the timer circuit 312 is in electrical communication with the input terminal L1, and the output side of the timer circuit 312 is in electrical communication with the transformer 314. As will be described below in more detail, the timer circuit 312 eliminates the need for the second switch SW 2 in the spark switch 260.

In operation, the timer circuit 312 provides a time delay between the time the reignition spark module 310 receives electrical power and the time the spark electrode 320 ignites fuel in the burner base 330. It should be appreciated that the timer circuit 312 may be any suitable circuit necessary to generate the time delay. For example, the timer circuit may be a 555 timer circuit. It should be appreciated that the time delay may be any suitable amount of time. For example, the time delay may be between 5 seconds and 10 seconds.

Figure 12:
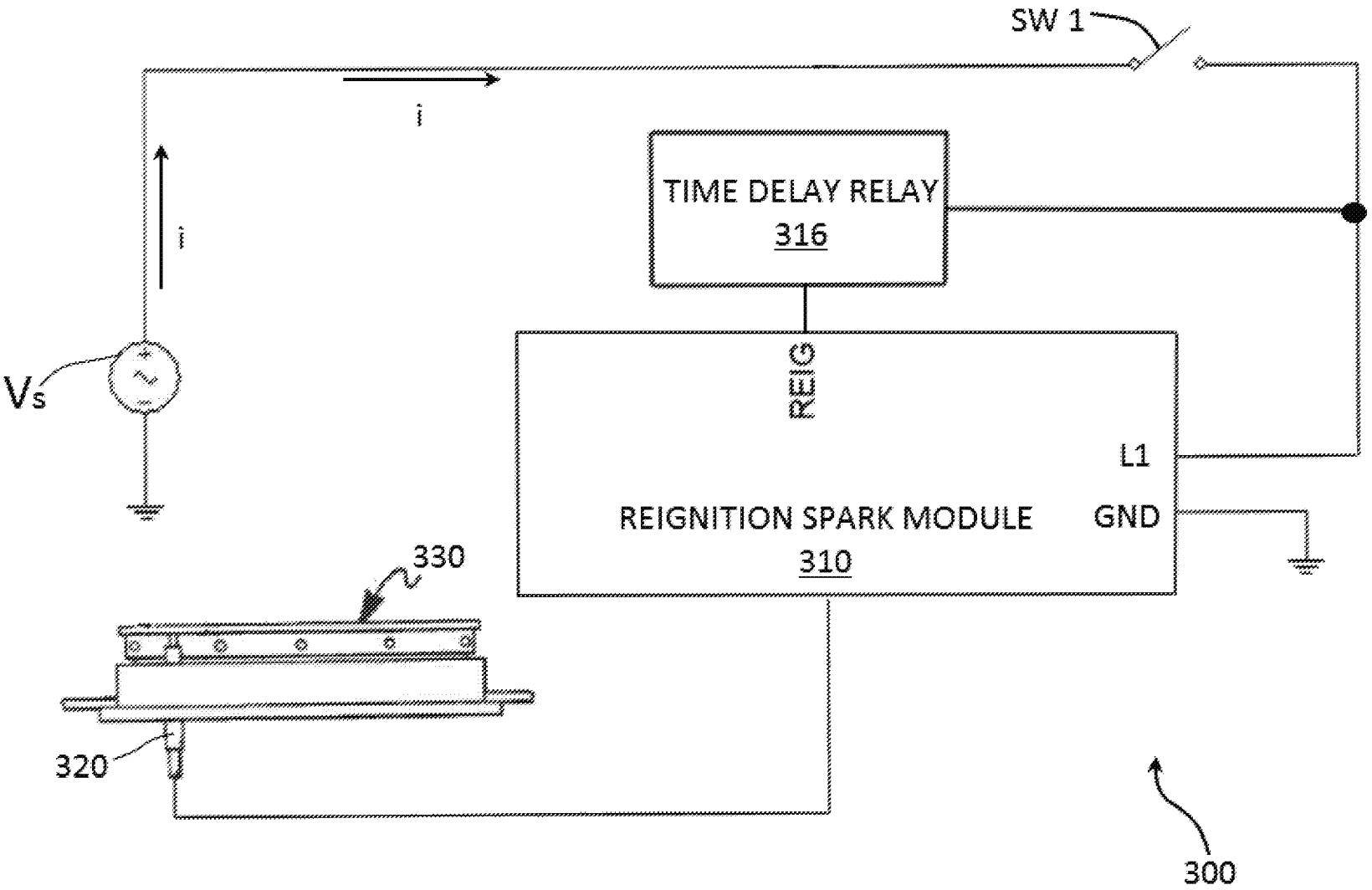
FIG. 12 provides a circuit diagram indicating still another embodiment of the spark generator in accordance with the present disclosure.

Referring now to FIG. 12, another embodiment of the spark generator 300 is illustrated in accordance with the present disclosure. The exemplary spark generator 300 depicted in FIG. 12 may be configured in substantially the same manner as the exemplary spark generator 300 depicted in FIG. 5, and accordingly, the same or similar numbers may refer to the same or similar parts. For example, the spark generator includes a reignition spark module 310 and a spark generator 320.

However, for the embodiment of FIG. 12, the spark module 310 includes a time delay relay 316. In particular, the time delay relay 316 is in electrical communication with both the first switch SW 1 and the reignite terminal REIG of the reignition spark module 310. As will be described below in more detail, the time delay relay 316 eliminates the need for the second switch SW 2 in the spark switch 260.

In operation, the time delay relay 316 introduces a time delay between the time the reignition spark module 310 receives electrical power and the time the spark electrode 320 ignites fuel in the burner base 330. More specifically, the time delay relay 316 temporarily inhibits a flow of the electric current (i) from the power supply $V_S$ to the reignite terminal REIG of the reignition spark module 310. Thus, the time delay relay 316 delays ignition of the fuel in the burner base 330.

It should be appreciated that the time delay relay 316 may be any suitable relay necessary to generate the time delay. It should also be appreciated that the time delay may be a discrete component relative to both the reignition spark module 310 and the spark electrode 320.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

a control valve having a rotatable member for controlling gas flow rates to a burner assembly;

a spark generator configured to provide a spark to ignite gas in the burner assembly; and a spark switch mounted to the control valve, the spark switch comprising:

a rotor fixedly mounted to the rotatable member, the rotor rotatable to at least a first position and a second position, the rotor comprising a first cam and a second cam, the first cam and the second cam each extending radially outward from an exterior surface of the rotor, the first cam and the second cam each extending circumferentially along the exterior surface of the rotor, wherein the first cam and the second cam are circumferentially spaced from one another along the exterior surface of the rotor;

a first switch movable between an open position and a closed position; and a second switch movable between the open position and the closed position, wherein when the rotor is in the first position, the first switch is in the closed position, the second switch is in the open position, and the spark generator receives a first electrical current from a power supply via the first switch, and wherein when the rotor is in the second position, the first switch is in the closed position, the second switch is in the closed position, the spark generator receives the first electrical current via the first switch, and the spark generator receives a second electrical current from the power supply via the second switch.

2. The cooktop appliance of claim 1, wherein the spark generator includes a reignition spark module and a spark electrode, wherein the first electrical current flows to an input voltage terminal of the reignition spark module, and wherein the second electrical current flows to a reignite terminal of the reignition spark module.

3. The cooktop appliance of claim 1, wherein the rotor is rotatable from an initial position to the first position along a first direction, and wherein the rotor is rotatable from the first position to the second position along the first direction.

4. The cooktop appliance of claim 3, wherein when the rotor is in the initial position:

the first switch is in the open position such that the spark generator does not receive the first electrical current from the power supply; and the second switch is in the open position such that the spark generator does not receive the second electrical current from the power supply.

5. The cooktop appliance of claim 1, wherein the first cam extends circumferentially along greater portion of the exterior surface than the second cam.

6. The cooktop appliance of claim 1, wherein when the rotor is in the first position, the first cam contacts the first switch, and wherein when the rotor is in the second position, the first cam contacts the first switch and the second cam contacts the second switch.

7. The cooktop appliance of claim 6, wherein when the first cam contacts the first switch, the first switch moves from the open position to the closed position, and wherein when the second cam contacts the second switch, the second switch moves from the open position to the closed position.

8. The cooktop appliance of claim 1, wherein when the rotor rotates from the first position to the second position, the rotor rotates between 12 degrees and 23 degrees.

* * * * *